US008714880B1

(12) United States Patent
Mitchell

(10) Patent No.: US 8,714,880 B1
(45) Date of Patent: May 6, 2014

(54) METHOD AND APPARATUS FOR LIFTING AND SUPPORTING A BUILDING STRUCTURE

(75) Inventor: Brad Mitchell, Olathe, KS (US)

(73) Assignee: Earth Contact Products, L.L.C., Olathe, KS (US)

( * ) Notice: Subject to any disclaimer, the term of this patent is extended or adjusted under 35 U.S.C. 154(b) by 0 days.

(21) Appl. No.: 12/699,873

(22) Filed: Feb. 3, 2010

Related U.S. Application Data

(60) Provisional application No. 61/149,344, filed on Feb. 3, 2009.

(51) Int. Cl.
*E02D 5/00* (2006.01)

(52) U.S. Cl.
USPC ..... 405/230; 405/232

(58) Field of Classification Search
USPC ..... 405/230, 231, 232, 256, 257
See application file for complete search history.

(56) References Cited

U.S. PATENT DOCUMENTS

| | | | | |
|---|---|---|---|---|
| 4,678,373 | A | 7/1987 | Langenbach, Jr. | |
| 5,013,190 | A | 5/1991 | Green | |
| 5,120,163 | A | 6/1992 | Holdeman et al. | |
| 5,154,539 | A | 10/1992 | McCown, Sr. et al. | |
| 5,171,107 | A | 12/1992 | Hamilton et al. | |
| 5,213,448 | A | 5/1993 | Seider et al. | |
| 5,951,206 | A | 9/1999 | Gregory | |
| 6,079,905 | A | 6/2000 | Ruiz et al. | |
| 6,142,710 | A | 11/2000 | Holland, Jr. et al. | |
| 6,193,442 | B1 | 2/2001 | May | |
| 6,352,390 | B1 | 3/2002 | Jones | |
| 6,514,012 | B2 | 2/2003 | Gregory et al. | |
| 6,676,335 | B1 * | 1/2004 | Hickman | 405/230 |
| 6,840,714 | B1 | 1/2005 | Vache | |
| 6,872,031 | B2 | 3/2005 | May | |
| 7,094,003 | B2 | 8/2006 | Faires et al. | |
| 7,097,388 | B1 | 8/2006 | Mansour et al. | |
| 7,165,915 | B2 | 1/2007 | Queen | |
| 7,402,002 | B2 | 7/2008 | Zidar et al. | |
| 7,470,090 | B2 | 12/2008 | Heppner | |
| 2006/0269364 | A1 * | 11/2006 | May | 405/232 |
| 2007/0065232 | A1 | 3/2007 | Faries et al. | |
| 2008/0014028 | A1 | 1/2008 | Faires et al. | |
| 2008/0170912 | A1 | 7/2008 | Kaufman | |

* cited by examiner

*Primary Examiner* — Benjamin Fiorello
(74) *Attorney, Agent, or Firm* — Erickson, Kernell, Derusseau & Kleypas, LLC

(57) ABSTRACT

A method and apparatus for installing remedial piers in which substantially vertical piers are located in close proximity to the wall and footing of an existing structure and are drilled to a substantial depth to penetrate a rock stratum or debris-laden soil. The piers support the structure upon eccentric brackets to transfer the structural load from the footing to the piles. Installation of the piers is followed by a continuous lift of the structure via hydraulic manifold.

9 Claims, 5 Drawing Sheets

METHOD AND APPARATUS FOR LIFTING AND SUPPORTING A BUILDING STRUCTURE

CROSS REFERENCE TO RELATED APPLICATION

This application claims the benefit of the prior filed, provisional application Ser. No. 61/149,344, filed Feb. 3, 2009.

BACKGROUND OF THE INVENTION

1. Field of the Invention

The present invention relates to a method and associated apparatus for lifting, stabilizing and supporting a pre-existing building structure, and more particularly, a method for using a series of brackets to attach a building structure to piers drilled vertically into the ground proximate the building structure, and lifting the brackets substantially concurrently to raise the building structure relative to the piers.

2. Description of the Related Art

Methods for lifting pre-existing building structures upon piers driven into the ground around a portion of the structure typically utilize hydraulic rams that drive steel pier pipes into the ground until either sufficient ground resistance is achieved or the lower end of the pier strikes a suitable load-bearing rock stratum. Because hydraulic rams require relatively little horizontal space, a ram assembly may be positioned relatively close to a structure. Piers may thereby be installed in relative close proximity to the structure foundation, which is preferred in most cases. Helical and threaded piers are drilled into the ground using a drill rig assembly, rather than via hydraulic ram, and may offer advantages in certain substrates. Because of the dimensions of a typical drill rig assembly, however, which typically includes a base, stand and drill head, a vertically drilled pier cannot typically be installed as close horizontally to a building structure as a hydraulically driven vertical pier. Typical solutions in the prior art for installing drilled piers closer to a structure include notching the structure footing or drilling the pier into the ground as an angle so that the lower portion of the pier may lie in closer proximity to the footing. Each such solution presents disadvantages in that the first may compromise the structural integrity of the footing, as well as increase installation labor, and the second solution yields a pier unable to bear the same load as a vertically oriented pier.

What is needed is a method and apparatus that allows use of drilled piers in close proximity to a building structure so that piers may be drilled a substantial distance into a rock stratum while maintaining a substantially vertical disposition.

SUMMARY OF THE INVENTION

Embodiments of the present invention comprise means for stabilizing and lifting a building structure using continuous lift methodologies in combination with hollow, threaded bar piers installed proximate to foundations of preexisting structures. In particular, certain embodiments utilize relatively small diameter, threaded, micro piles drilled into the ground using a rotary drill head. Other embodiments utilize larger diameter, unthreaded, pier pipes installed via hydraulic ram. A micro pile typically comprises a hollow, threaded, steel bar that carries concrete slurry, also referred to as grout, through its central cavity to flow from one or more apertures proximate a drill bit. The micro pile and drill bit are driven by a rotary drill head attached to the end of the micro pile distal from the drill bit. The grout is under pressure and as the micro pile is drilled into the ground, grout flowing from the apertures fills the space between the walls of the shaft created by the drill bit and the micro pile, which is of smaller diameter than the drill bit.

The micro pile is attached to the structure to be stabilized or lifted by an offset or eccentric pier bracket. The eccentric pier bracket allows for additional space between the micro pile and the structure, thereby providing sufficient room for a drill head and associated support apparatus.

Other advantages of the invention will become apparent from the following description taken in connection with the accompanying drawings, wherein is set forth by way of illustration and example several embodiments of the present invention.

DETAILED DESCRIPTION

Figure 1:
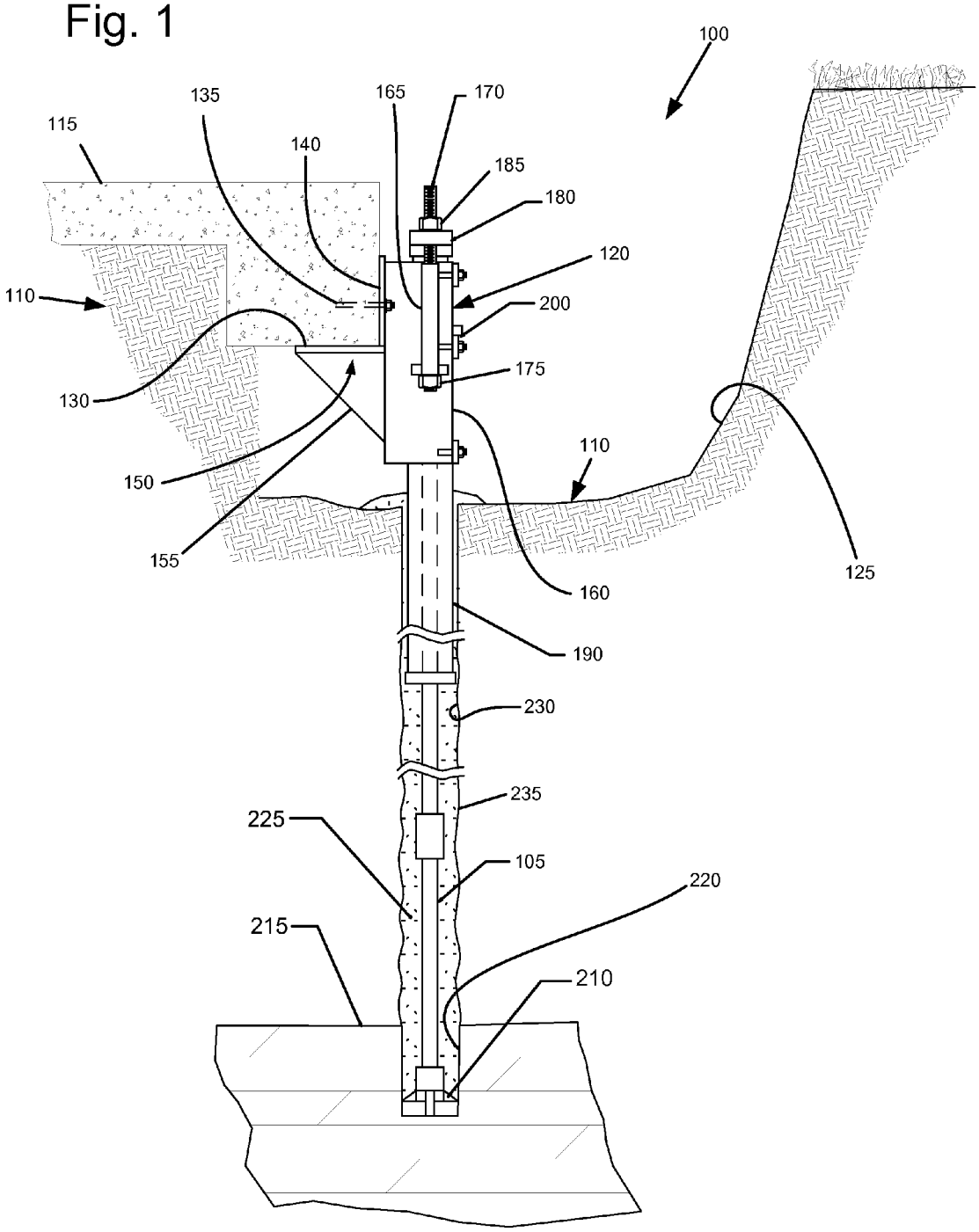
FIG. 1 is a side view of micro pile or micro pier drilled into ground proximate a building structure footing with the pier attached to the footing using an eccentric pier bracket.

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawings. FIGS. 1 through 7 illustrate several embodiments of a pier driving system, and elements thereof, for stabilizing and lifting preexisting structures built upon foundations such as poured concrete or masonry footings.

FIG. 1 is a side view of a micro pile pier 100 including a hollow micro pile shaft 105 drilled into ground 110 proximate a building structure footing 115 with the pier 100 attached to the footing 115 using an eccentric pier bracket 120. As illustrated, soil has been excavated from an area proximate the footing 115, and the desired location of a pier 100 and bracket 120, to form a hole 125 for positioning the pier assembly. (In the figures, footings, slabs, walls, grout columns, and soil and rock strata are shown in cross section). In general, holes 125 are excavated along the perimeter, or along the side, of a portion of a structure to be lifted. An eccentric bracket 120 is shown secured to the footing 115 so that the horizontal bearing plate 130 underlies the footing 115. Fasteners 135 such as screws or bolts adapted for secure fastening to concrete, are driven into the foundation or footing surface adjoining the vertical plate 140 through one or more holes 145 (see FIG. 4)

provided in the vertical plate 140 in order to attach the bracket 120 securely to the footing 115.

The vertical plate 140 and horizontal bearing plate 130 form a right angle bracket 150. The horizontal bearing plate 130 is supported by a pair of triangular support plates 155 that are attached to, or integral with, rectangular side plates 160. The left side plate 160*a* and left support plate 155*a* of a bracket are shown in several of the figures including FIGS. 1 and 4. The back view of a bracket 120 provided in FIG. 6, shows both left 160*a* and right 160*b* side plates.

A guide or lift rod support collar 165 is welded or otherwise attached to the outside surface of each side plate 160 in vertical orientation. An adjustable, threaded lift rod 170 passes through each collar 165 and terminates at the lower end with a threaded nut 175. A pier cap 180 spans both lift rods 170 and crosses over the space between and over the side plates 160. A nut 185 at the upper end of each lift rod 170 secures the pier cap 180. The channel or space between the side panels 160 is sized to accommodate a pier sleeve 190 for holding either a pier pipe 195 or micro pier shaft 105. After the sleeve 190 is placed within the channel, it is retained by installing the upper 200*a*, middle 200*b* and lower 200*c* face plates.

Figure 3:
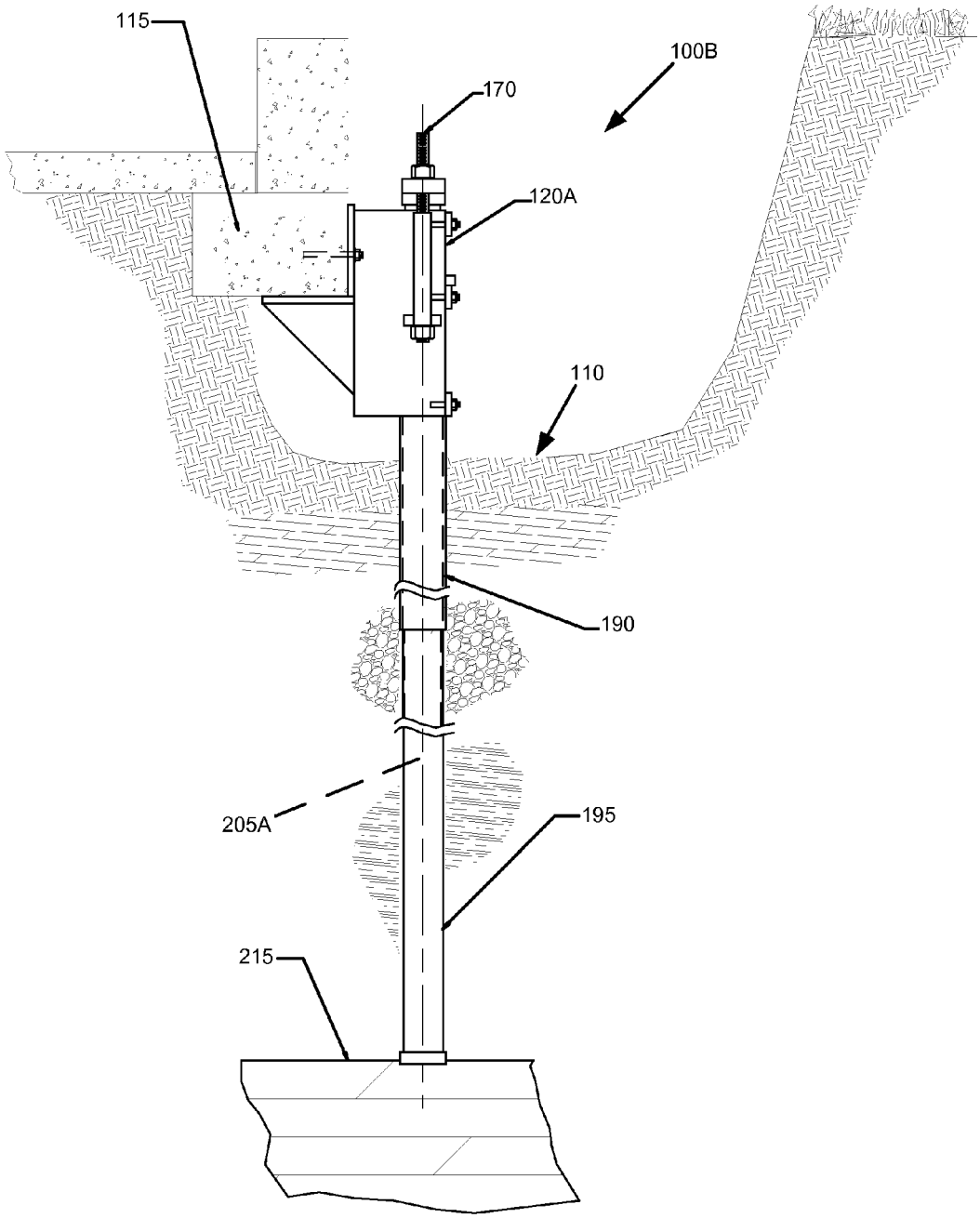
FIG. 3 is a side view of a pipe pier hydraulically driven into ground proximate a building structure footing with the pier attached to the footing using an eccentric pier bracket of increased width relative to the brackets shown in FIGS. 1 and 2.
Figure 4:
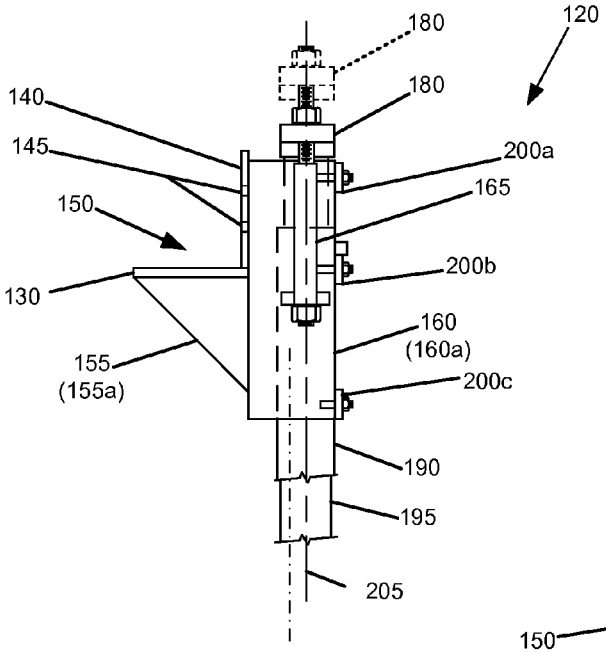
FIG. 4 is a side view of an eccentric pier bracket.
Figure 5:
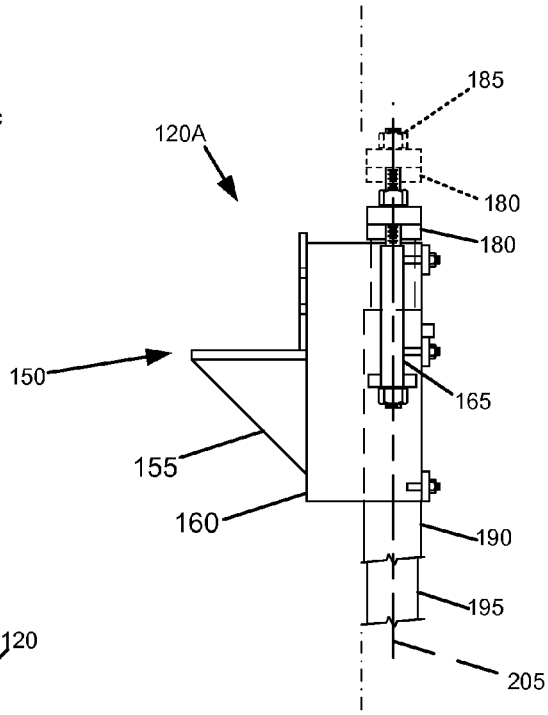
FIG. 5 is a side view of an alternative embodiment of an eccentric pier bracket.
Figure 6:
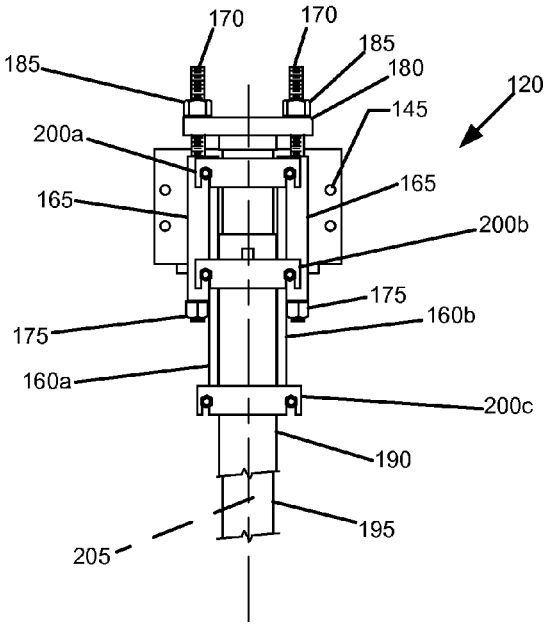
FIG. 6 is a back view of an eccentric pier bracket.
Figure 7:
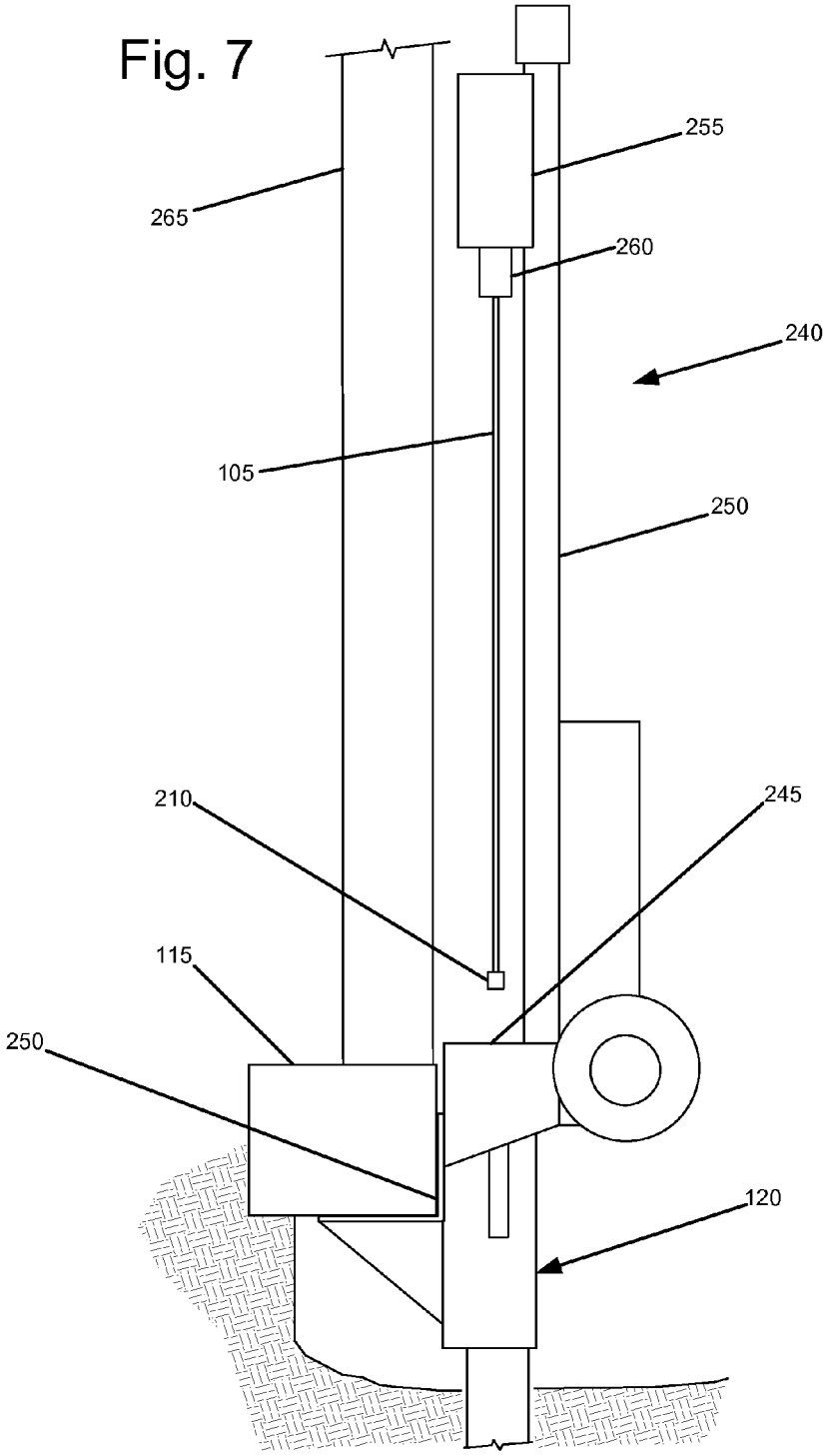
FIG. 7 is a side view of a drilling rig mounted to an eccentric pier bracket.

With particular reference to FIGS. 4 through 6, an eccentric pier bracket 120 differs from brackets in the prior art in that the axis 205 of the pier is moved further from the building structure to allow room for machinery used to drive the pier 100 into the ground. In the embodiments shown herein, this is accomplished by increasing the width of the side plates 160 (side plate width runs left to right as shown in FIGS. 1 through 5) so that the pier axis 205, as well as the threaded lift or guide rods 170 and collars 165, are moved a further distance from the right angle bracket 150.

FIG. 1 illustrates a micro pile 105 drilled into the ground 110 proximate the footing 115 of an existing structure. Because the micro pile 105 is fitted with a sacrificial drill bit 210, it may be drilled not only to reach a suitable load bearing rock stratum 215 but may also be drilled into the rock to create and fit within a pocket 220. As the drill bit 210 moves downward, grout 225 is forced through apertures (not shown) proximate the drill bit 210 to fill the void 230 surrounding the micro pile 105. When hardened, the grout 225 forms a load-bearing column 235. Because of the irregular outer surface of the grout column 235, the pier 100 provides strong frictional and mechanical resistance to vertical movement once the grout 225 sets, even if a pier 100 is installed without reaching rock 215.

Micro piles 105 are drilled into the ground 110 using a drill rig 240 (see FIG. 7) typically comprising a base 245 that attaches to the pier bracket 120, and a vertically disposed stand 250 that projects upward from the base 245. A rotary drill head 255 is mounted to and slides along the stand 250. Threaded, hollow micro pile 105 is coupled to the drill rotor 260. The drill head 255 moves downward along the stand 250 as the pile 105 is drilled into the ground 110. Typically, the drill head 255 is hydraulically powered. As shown, because the pier bracket 120 is eccentric, sufficient space between the pier axis 205 and the building structure (wall 265) is provided to accommodate the drill rig 240.

Figure 2:
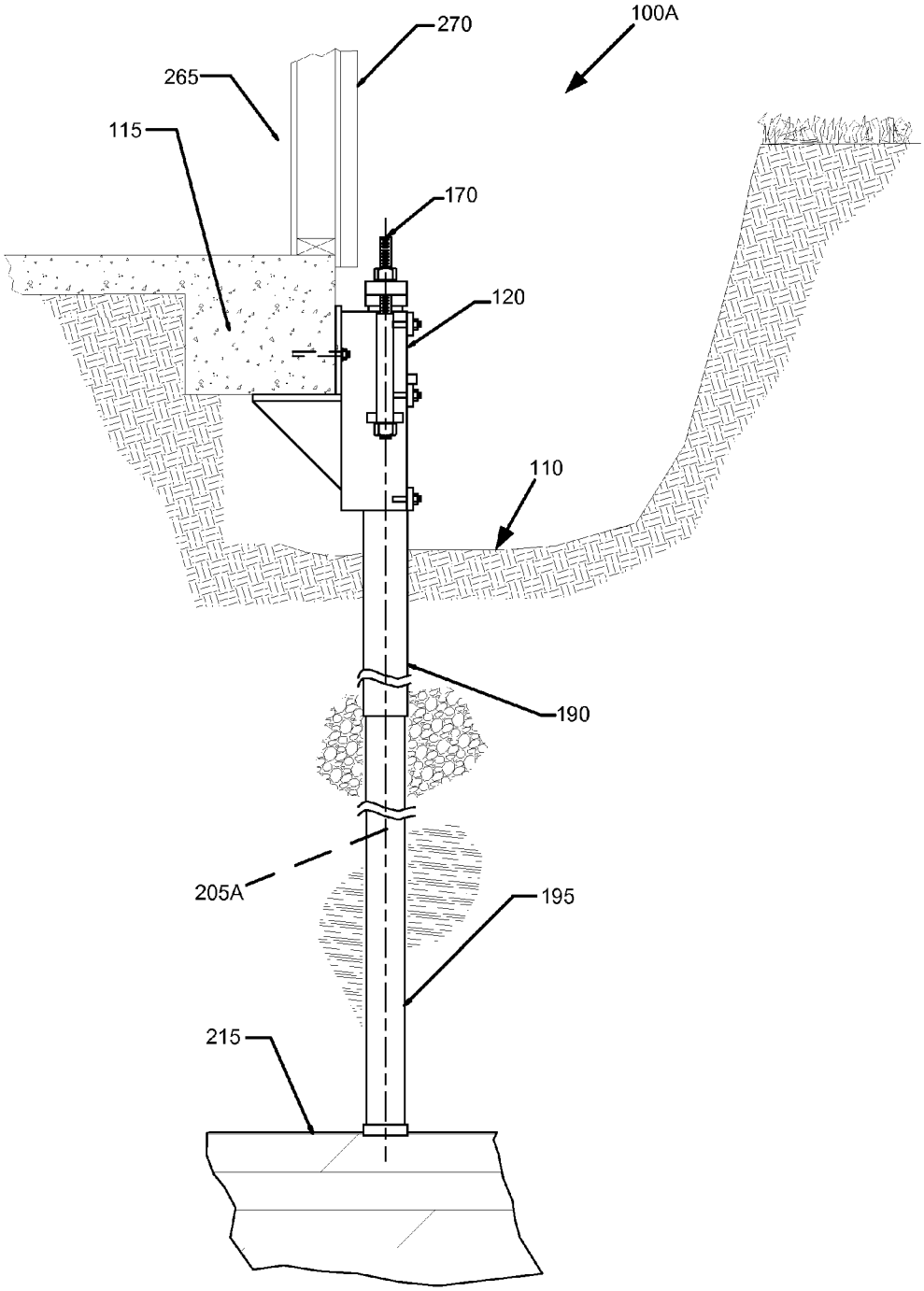
FIG. 2 is a side view of a pipe pier hydraulically driven into ground proximate a building structure footing with the pier attached to the footing using an eccentric pier bracket.

FIG. 2 is a side view of a pipe pier 100A hydraulically driven into ground 110 proximate a building structure footing 115 with the pier 100A attached to the footing using an eccentric bracket 120. The eccentric bracket 120 allows for installation of the pier 100A by providing sufficient additional space from the pier axis 205A to the structure wall 265 (including siding 270) to accommodate a hydraulic ram (not shown).

FIG. 3 is a side view of a pipe pier 100B hydraulically driven into ground 110 proximate a building structure footing 115 with the pier 100B attached to the footing 115 using an eccentric bracket 120A (see also FIG. 5) of increased width (offset) relative to the brackets 120 shown in FIGS. 1 and 2. By way of example, embodiments of the bracket 120 shown in FIGS. 1 and 2 may provide a 4½ inch pier offset (the distance between the vertical plate 140 and the pier axis 205) while the bracket 120A shown in FIG. 3 may provide a 6½ pier offset.

Further embodiments of an eccentric pier bracket may include a vertical plate and a horizontal plate abutting one another at a substantially right angle therebetween to form a right angle bracket. The horizontal plate is supported by one or more support plates positioned below the horizontal plate to receive force applied downward to the horizontal plate. A left side plate and an opposing right side plate are spaced apart and positioned generally parallel to one another. Each side plate is attached to the rearward face of the vertical plate and extends below the vertical plate and the horizontal plate to attach to the support plate. Downward and lateral forces applied to the bracket are thereby substantially transferred to said side plates. The side plates each have a longitudinal axis traversing the center portion of each side plate. These longitudinal axes have generally vertical dispositions when the eccentric bracket is operatively positioned in a pier assembly attached to a building structure. A cylindrical support collar has a longitudinal axis and is vertically disposed between the side plates and rearward of the vertical plate so that the support collar longitudinal axis is rearward of the side plate longitudinal axes.

Another embodiment of a pier bracket system for lifting a building structure such as a foundation or footing and the like may include a horizontal plate having a top surface and a bottom surface, a front edge and a rear edge, the horizontal plate being used for insertion at its front edge under a building structure. A vertical plate is mounted at its lower edge to a rearward portion of the top surface of the horizontal plate and extends substantially across and over the rear edge. A left side plate and a right side plate, each vertically oriented, are spaced apart and joined by attachment of the front edge of each side plate to the rear surface of the vertical plate, which spans the front edges of the side plates. A left gusset and a right gusset support the horizontal plate. The left gusset has a horizontal top edge attached along a portion of the bottom surface of the horizontal plate proximate the left margin of the horizontal plate. The left gusset has a rearward facing vertical rear edge attached to a lower portion of the front edge of the left side plate. The right gusset has a horizontal top edge attached along a portion of the bottom surface of the horizontal plate proximate the right margin of the horizontal plate. The right gusset has a rearward facing vertical rear edge attached to a lower portion of the front edge of the right side plate. The side plates are spaced apart horizontally by a distance sufficient to accommodate a pier support sleeve therebetween. The side plates each have a vertically oriented longitudinal axis and the pier support sleeve has a vertically oriented longitudinal axis. The pier support sleeve is positioned between the side plates so that the longitudinal axis of the pier support sleeve is positioned rearward of the longitudinal axes of the side plates. In this manner, the side plates are forwardly eccentric of the pier sleeve and the distance between the vertical bracket and the pier support sleeve is increased sufficiently to allow accommodation of a drill head above the pier support sleeve.

It is to be understood that while certain forms of this invention have been illustrated and described, it is not limited thereto except insofar as such limitations are included in the following claims and allowable equivalents thereof.

The invention claimed is:

1. An eccentric pier bracket comprising:

a vertical plate and a horizontal plate abutting one another at a substantially right angle therebetween to form a bracket, said horizontal plate supported by one or more support plates positioned below said horizontal plate to receive force applied downward to said horizontal plate, a left side plate and an opposing right side plate, spaced apart, and positioned generally parallel to one another and each attached to the rearward face of said vertical plate and extending below said vertical plate and said horizontal plate to attach to said support plate, whereby downward and lateral forces applied to said bracket are substantially transferred to said side plates, said side plates each having a longitudinal axis traversing the center portion of each side plate, said longitudinal axes having a generally vertical disposition when said eccentric bracket is operatively positioned, and a support collar comprising a cylinder and having a longitudinal axis, said support collar vertically disposed between said side plates and rearward of said vertical plate so that support collar longitudinal axis is rearward of said side plate longitudinal axes a distance sufficient to accommodate a rotary drill head.

2. A pier bracket system for lifting a building structure such as a foundation comprising:

a horizontal plate having a top surface and a bottom surface, a front edge and a rear edge, said horizontal plate for insertion at the front edge under a building structure, a vertical plate mounted at a lower edge thereof to a rearward portion of the top surface of said horizontal plate and extending substantially across and over said rearward portion, a left side plate and a right side plate each vertically oriented, spaced apart and joined by attachment of the front edge of each to the rear surface of said vertical plate, a left gusset for supporting said horizontal plate, said left gusset having a horizontal top edge attached along a portion of said bottom surface of said horizontal plate proximate the left margin thereof, said left gusset having a rearward facing vertical rear edge attached to a lower portion of said front edge of said left side plate, a right gusset for supporting said horizontal plate, said right gusset having a horizontal top edge attached along a portion of said bottom surface of said horizontal plate proximate the right margin thereof, said right gusset having a rearward facing vertical rear edge attached to a lower portion of said front edge of said right side plate, said side plates being spaced apart horizontally by a distance sufficient to accommodate a pier support sleeve therebetween, said side plates each having a vertically oriented longitudinal axis, said pier support sleeve having a vertically oriented longitudinal axis, said pier sleeve positioned between said side plates so that the longitudinal axis of said pier support sleeve is positioned rearward of said longitudinal axes of said side plates, whereby, said side plates are forwardly eccentric of said pier sleeve and the distance between said vertical plate and said pier support sleeve is increased sufficient to allow accommodation of a rotary style drill head above said pier support sleeve when said horizontal plate is engaged with a building structure, said drill head for rotationally installing a pier pile for use by said pier bracket system.

3. The system as in claim 2, further comprising a pier pile positioned within said pier support sleeve and in rotational engagement with said drill head.

4. An eccentric pier bracket assembly comprising:

a vertical plate and a horizontal plate abutting one another at a substantially right angle therebetween to form a bracket, said horizontal plate supported by one or more support plates positioned below said horizontal plate to receive force applied downward to said horizontal plate, a left side plate and an opposing right side plate, spaced apart, and positioned generally parallel to one another and each attached to said vertical plate, whereby downward and lateral forces applied to said bracket are substantially transferred to said side plates, said side plates each having a longitudinal axis traversing the center portion of each side plate, said longitudinal axes having a generally vertical disposition when said eccentric bracket is operatively positioned, a sleeve for surrounding a portion of a pier, said sleeve removably securable to said bracket, said sleeve vertically disposed between said side plates and rearward of said vertical plate so that the longitudinal axis of said sleeve is rearward of the longitudinal axis of either said side plate, said sleeve secured to said bracket by inserting said sleeve into a channel in said bracket and retaining said sleeve in said channel by barricading all longitudinal sides of said channel, and a cap for supporting said bracket on a pier, said cap for engaging the topmost surface of an installed pier.

5. The eccentric pier bracket of claim 1, further comprising a pile attached at one end thereof to said drill head.

6. The eccentric pier bracket of claim 5, further comprising a drill bit attached to an end of said pile distal to said drill head.

7. The eccentric pier bracket of claim 6, further comprising a central cavity in said pile for carrying concrete slurry through said pile to flow from one or more apertures proximate said drill bit as said pile is drilled into the ground.

8. The system as in claim 3, further comprising a drill bit attached to an end of said pile distal to said drill head.

9. The system as in claim 8, further comprising a central cavity in said pile for carrying concrete slurry through said pile to flow from one or more apertures proximate said drill bit as said pile is drilled into the ground.

* * * * *